US005897052A

United States Patent [19]

Tanaka et al.

[11] Patent Number: 5,897,052

[45] Date of Patent: Apr. 27, 1999

[54] EASILY LATERALLY OPENED TYPE PAPER CONTAINER

[75] Inventors: Arata Tanaka; Katsuyuki Ohkubo; Kazuhiko Sase, all of Tokyo, Japan

[73] Assignee: Nippon Paper Industries Co., Ltd., Tokyo, Japan

[21] Appl. No.: 08/756,802

[22] Filed: Nov. 26, 1996

[30] Foreign Application Priority Data

Nov. 27, 1995 [JP] Japan ..... 7-307226

[51] Int. Cl.[6] ..... B65D 17/34

[52] U.S. Cl. ..... 229/205; 229/238; 229/926; 383/201; 383/205; 383/908

[58] Field of Search ..... 229/205, 238, 229/926, 87.05; 383/205, 201, 908

[56] References Cited

U.S. PATENT DOCUMENTS

| | | | |
|---|---|---|---|
| 2,370,079 | 2/1945 | Schmidt | 383/205 |
| 2,383,728 | 8/1945 | Little | 383/205 |
| 2,725,172 | 11/1955 | McCullough et al. | 383/205 |
| 3,291,377 | 12/1966 | Eggen | 383/205 |
| 3,426,936 | 2/1969 | Palmer | 383/205 |
| 3,566,752 | 3/1971 | Dreher | 383/205 |
| 4,411,365 | 10/1983 | Horikawa et al. | 229/205 |
| 4,834,245 | 5/1989 | Ohga et al. | 383/201 |
| 5,582,342 | 12/1996 | Jud | 383/205 |

*Primary Examiner*—Stephen P. Garbe
*Attorney, Agent, or Firm*—Wenderoth, Lind & Ponack,L.L.P.

[57] ABSTRACT

The provision of an easily laterally opened type paper container includes: a paper base material which is made of material having thermoplastic resin layers on both sides thereof; an opening piece which is formed of a resin film, and sandwiched and bonded between an upper piece and a lower piece of an overlap width portion of the paper base material which is overlapped and laminated on each other with a picking length; a notch portion defined in the upper piece of said overlap width portion in correspondence with both ends of said opening piece laterally; and an oriented polyolefine film having such a characteristic that an orientation magnification of the film in one direction is larger than that in a direction orthogonal to the one direction, which is stacked on an inner surface of the paper container material in such a manner that the one direction having the larger orientation magnification coincides with an opening direction of the paper container.

20 Claims, 10 Drawing Sheets

EASILY LATERALLY OPENED TYPE PAPER CONTAINER

BACKGROUND OF THE INVENTION

1. Field of the Invention

The present invention relates to a laminated paper container (hereinafter referred to as paper container, simply) for containing liquid such as juice or a gel-like food such as bean-curd or jelly, and more particularly to a paper container which is easily laterally opened.

2. Description of the Related Art

Paper containers have been popularly used for the purpose of containing a liquid such as juice or sake, or a gel-like food such as bean-curd or jelly, because the paper container as used can be readily disposed of and the liquid or the gel-like food contained in the paper container can be preserved at room temperature for a long period of time. Up to now, as a means for opening the above paper container, there has been known a type in which, as disclosed in Japanese Patent Unexamined Publication No. Sho 55-154240, a perforated line 3 is indicated on a corner of an upper lateral seal portion 2 of a paper container (FIG. 17), and the corner of the lateral seal portion 2 is pulled up and cut along the perforated line 3 when opening the paper container so that a spout 4 and an air passage 5 are opened as shown in FIG. 18, and a type in which a spout 6 is formed on a top wall of the paper container 1, and a pull tab tape 7 is laminated on the spout 6 as shown in FIG. 19.

However, when taking out the gel-like food such as bean-curd or jelly from the paper container with such an opening structure, it is difficult to take it out without destroying the contents thereof. As a result, a pair of scissors, a cutter or the like must be used to open the paper container, thereby causing a problem in that it gives a considerable amount of trouble.

SUMMARY OF THE INVENTION

The present invention has been made to overcome the above problem with conventional paper containers. Therefore an object of the present invention is to provide an easily laterally opened type paper container which can be opened without using a pair of scissors, a cutter or the like.

In order to solve the above problem, the present invention has been achieved by the provision of an easily laterally opened type paper container which comprises a container material which is made of a paper material having thermoplastic resin layers on both the outer surface and inner surface thereof. An opening piece having a suitable picking length, and which is formed of a resin film, is sandwiched and heat-sealed between an upper piece and a lower piece of an overlap portion of the container material which is overlapped and heat-sealed between one side and the other side thereof. Two notches are defined in the upper piece of the overlap portion in lateral correspondence with both sides of the opening piece. An oriented polyolefin film having a characteristic such that a stretching ratio of the film in one direction is larger than that in a direction orthogonal to the one direction is laminated to form one of the inner layers of the paper container in such a manner that the one direction having the larger stretching ratio coincides with an opening direction of the paper container.

With the above structure, when the opening piece is picked and pulled laterally, two notches defined in the upper piece of the overlap portion induce the paper container to be torn laterally. In addition, the oriented polyolefin film laminated to form one of the inner layers of the paper container makes it easy to tear the paper container laterally together with the opening piece. As a result, the paper container is readily cut in a belt-like shape, with the substantial width of the opening piece, without any trouble, starting from these notches, and thus separated into upper and lower portions. Then, with the removal of the upper portion thus separated, the paper container comes to be laterally opened so that the upper portion is wholly opened. Also, since the opening piece is formed of a resin film, the opening piece is readily deformed, with the result that in filling and forming processes for the paper container, even when the container material passes through a roller or the like, any trouble due to the opening piece being caught by the roller can be prevented from occurring. Hence, the paper container of the present invention can be used with no problems, even in aseptic packing, which requires that a sequence of processes such as a process for filling the paper container with liquid or food, a process for forming the paper container thus filled, and so on are automatically conducted in an aseptic chamber or the like. It should be noted that, in this specification, the aseptic packing means that the contents and the packing material, which have been kept in an aseptic condition in advance, are packed under aseptic conditions. A paper container of the aseptic type means a paper container suitable to be used for aseptic packing.

Also, it is preferable that a sealing tape is heat-sealed onto a rear side of the overlap portions of the container material which are overlapped and heat-sealed on each other in such a manner that the sealing tape is heat-sealed onto both rear sides, namely the rear side of the upper piece and the rear side of the lower piece. With this structure, the safety of sealing of the overlap portion can be enhanced.

Further, it is preferable that the opening piece is sandwiched and heat-sealed between the upper and lower pieces in such a manner that its one end is projected outwardly from an end portion of the lower piece. With this structure, the sealing strength between the upper piece and the sealing tape is weakened so that when the opening piece is picked and pulled, a cut-off portion of the upper piece is readily cut, thereby allowing easy opening the paper container.

Furthermore, it is preferable that the opening piece is heat-sealed to the container material in such a manner that its front surface, which is heat-sealed to the inner surface of the upper piece, is larger in adhesive strength than its rear surface. With this structure, when opening starts by pulling the opening piece, the rear surface of the opening piece readily peels off from the container material, and the front surface does not peel off therefrom because it is strongly heat-sealed onto the container material. Easy and accurate lateral opening of the paper container is thereby enabled by pulling the opening piece.

Still further, it is preferable that the opening piece is formed of a laminate comprising two or more layers.

Still further, it is preferable that two parallel half-cut lines, each of which is extended from the notches of the upper piece of the overlap portion, respectively, surround the container body laterally on an outer surface of the container material, with a depth that reaches the paper material. With this structure, when the opening piece is pulled laterally, those two half-cut lines on the paper container are cut, and a portion defined between those two half-cut lines is cut off in the belt-like shape without any trouble, thereby more surely conducting the opening of the paper container.

BRIEF DESCRIPTION OF THE DRAWINGS

The above and other objects and features of the present invention will be more apparent from the following description taken in conjunction with the accompanying drawings.

DETAILED DESCRIPTION OF THE PREFERRED EMBODIMENTS

Figure 1:
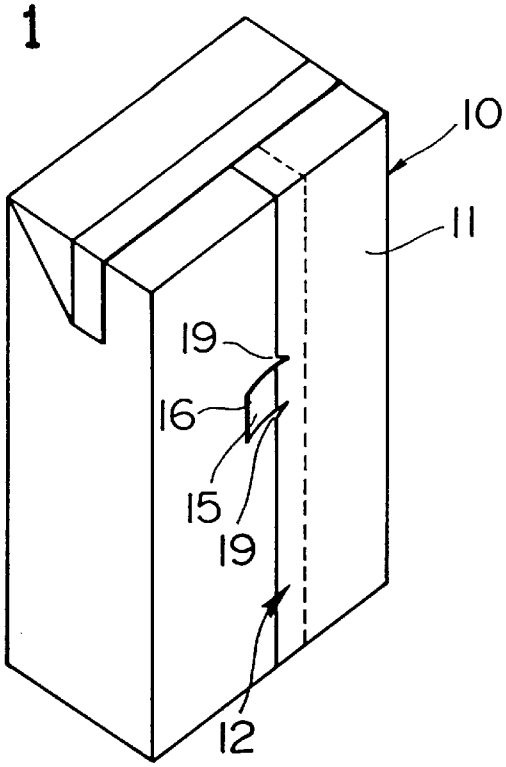
FIG. 1 is a perspective view showing an easily laterally opened type paper container in accordance with an embodiment of the present invention.

Now, a description will be given in more detail of preferred embodiments of the present invention with reference to the accompanying drawings.

FIGS. 1 to 4 show an easily laterally opened type paper container in accordance with one embodiment of the present invention. In this embodiment, a paper container 10 is so structured that both side ends of a container material 11, having a paper material on outer and inner surfaces of which low-density polyethylene films are laminated, respectively, are overlapped one on the other and then vertically sealed by thermally welding so as to be cylindrically formed. Upper and lower portions of the cylindrical container material 11 are then laterally sealed by thermally welding, respectively.

In the above structure, on an overlap width portion 12 of the paper container 10, an opening piece 15 formed of a resin film is heat-sealed in a state where one end of the opening piece 15 is sandwiched between an upper piece 13 and a lower piece 14. The pieces 13 and 14 are made up of both side ends of the container material 11, which are overlapped with each other when vertically sealing them. The other end of the opening piece 15 serves as a picking portion 16 and is projected laterally from the overlap portion 12.

Figure 3:
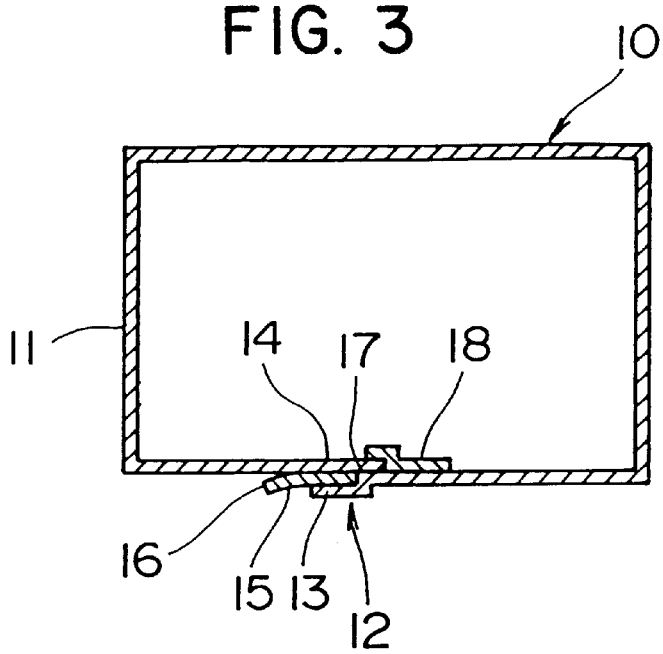
FIG. 3 is a lateral cross-sectional view showing a main portion of the easily laterally opened type paper container shown in FIG. 1.
Figure 4:
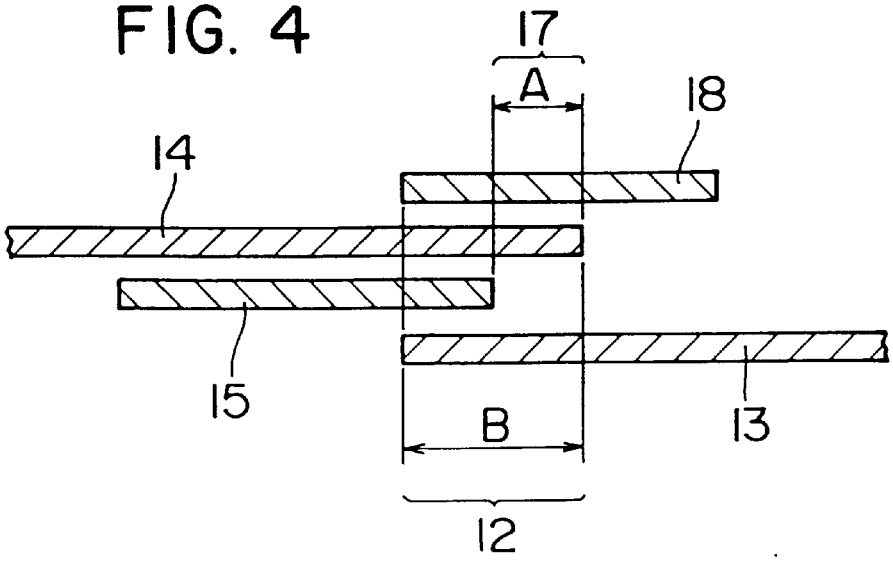
FIG. 4 is an explanatory diagram showing a main portion of the easily laterally opened type paper container shown in FIG. 1.

In this embodiment, the one end of the opening piece 15 is not held between the upper and lower pieces 13 and 14 over the entire width of the overlap portion 12, but held therebetween so as to be positioned inside of the end portion of the lower piece 14 as shown in FIGS. 3 and 4. As a result, there remains a sealing portion 17 where no opening piece 15 exists in the overlap portion 12. Further, a sealing tape 18 for enhancing the safety of sealing is heat-sealed on the rear surface of the overlap portion 12.

Figure 2:
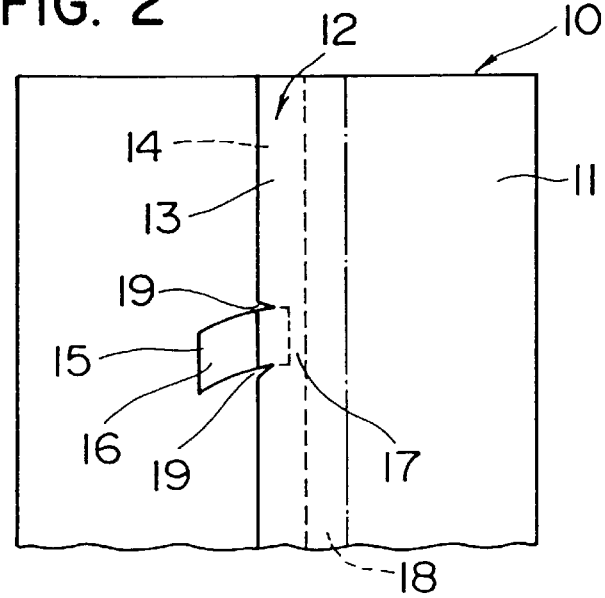
FIG. 2 is a side view showing a main portion of the easily laterally opened type paper container shown in FIG. 1.

Also, two notches 19 are provided on the upper piece 13 of the overlap portion 12 in correspondence with both sides (the vertically upper and lower sides as seen in FIG. 2) of the opening piece 15. It is preferable that the positions at which the notches 19 are defined perfectly coincide with both sides of the opening piece. However, no problem arises even though the former is slightly displaced with the latter.

An oriented polyolefin film 24 (FIG. 14), having a characteristic such that a stretching ratio of the film 24 in one direction is larger than that in a direction orthogonal to the one direction, is laminated to form one of the inner layers of the container material 11 of the paper container 10. The larger oriented direction of the film coincides with the opening direction of the container 10. The oriented polyolefin film 24 may be selected from an oriented polyethylene film, an oriented polypropylene film or the like. In this embodiment, the oriented polyethylene film is used as the oriented polyolefin film 24.

Figure 5:
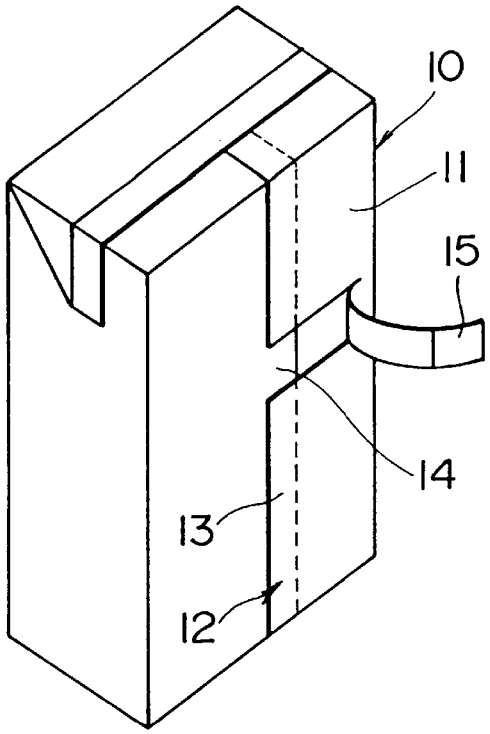
FIG. 5 is an explanatory diagram showing a state in which the easily laterally opened type paper container shown in FIG. 1 is being opened.

With the above structure, when the picking portion 16 of the opening piece 15 is picked and pulled laterally, the notches 19 defined in the upper piece 13 of the overlap portion 12 induce the paper container 10 to be laterally torn. In addition, the oriented polyolefin film 24, laminated to form one of the inner layers of the paper container 10, serves to tear the paper container 10 laterally together with the opening piece 15. As a result, the paper container 10 is readily cut off in a belt-like shape with the substantial width of the opening piece, starting from these notches 19, and is separated into upper and lower portions (FIG. 5). Then, with the removal of the upper portion thus separated, the paper container 10 comes to be laterally opened so that the upper portion is wholly opened. Also, since the opening piece 15 is formed of a resin film, the opening piece 15 is readily deformed with the result that in filling and forming processes, and so on, for the paper container, even when the container material 11 passes through a roller or the like, any trouble due to the opening piece 15 being caught by the roller can be prevented from occurring.

FIGS. 6 to 8, 9 and 10 show an easily laterally opened type paper container in accordance with another embodiment of the present invention. An opening piece 15 is sandwiched and heat-sealed between upper and lower pieces 13 and 14 of an overlap portion 12 of a paper container 10 in such a manner that one end of the opening piece 15 is projected outwardly from the end portion of the lower piece 14.

Figure 6:
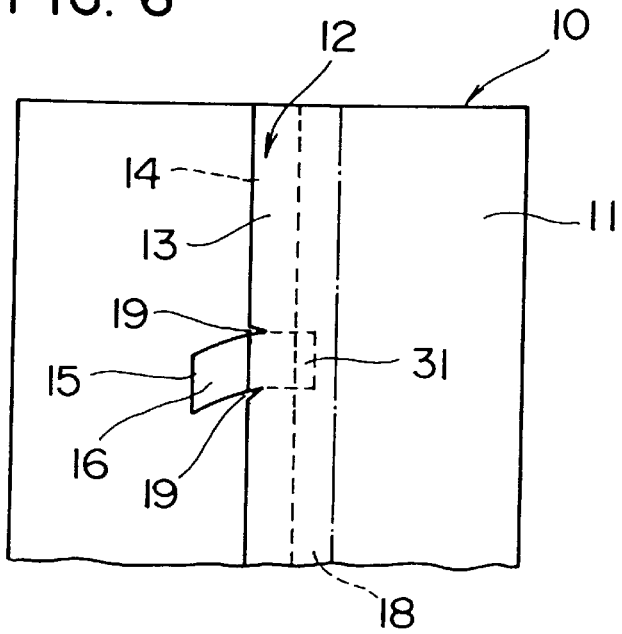
FIG. 6 is a side view showing a main portion of an easily laterally opened type paper container in accordance with another embodiment of the present invention.
Figure 7:
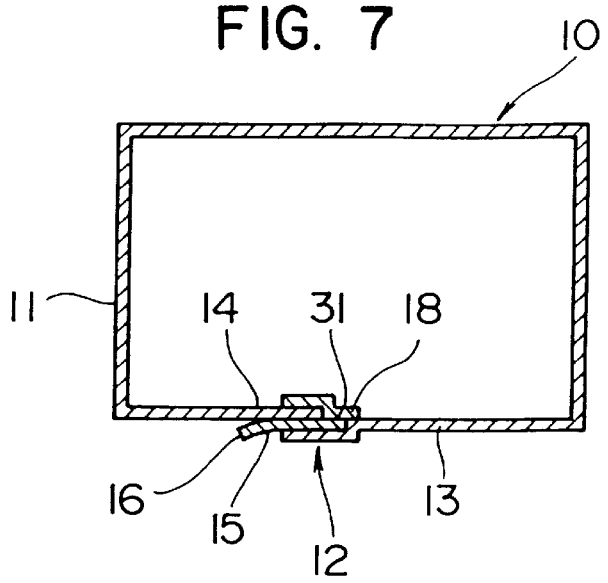
FIG. 7 is a lateral cross-sectional view showing a main portion of the easily laterally opened type paper container shown in FIG. 6.
Figure 8:
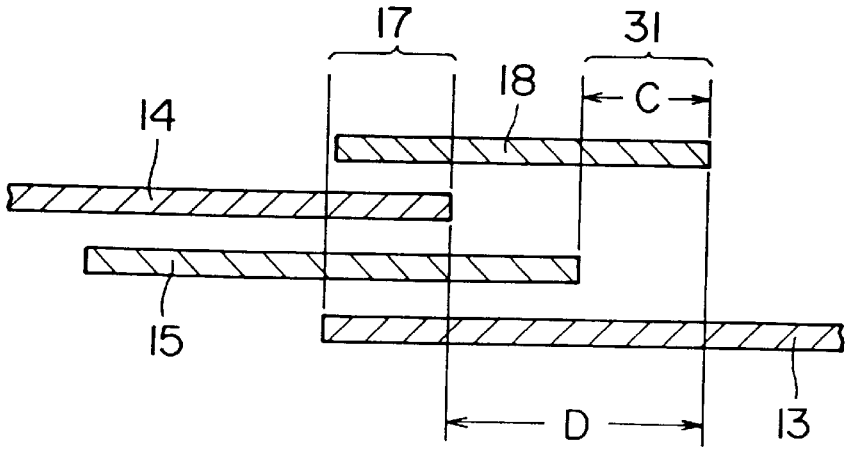
FIG. 8 is an explanatory diagram showing a main portion of the easily laterally opened type paper container shown in FIG. 6.

In the example shown in FIGS. 6 to 8, opening of the paper container is facilitated while keeping the sealing property, and the one end of the opening piece 15 is projected outwardly from the end portion of the lower piece 14, and held and heat-sealed between the sealing tape 18 and the upper piece 13 so as to be positioned inside of the end portion of the sealing tape 18. A sealing portion 31 where no opening sealing tape 18 remains between the sealing tape 18 and the upper piece 13. Although a suitable width C of the sealing portion 31 for easy opening, while keeping the sealing property, depends upon an overlapped width D of the sealing tape 18 and the upper piece 13, the shape of the base portion of the opening piece 15, and so on, it is preferable that the remaining width C of the sealing portion 31 is 20 to 70% of the overlapped width D of the sealing tape 18 and the upper piece 13 (FIG. 8).

With the above structure, the sealing strength between the upper piece 13 and the sealing tape 18 is weakened by the opening piece 15, which is interposed between the upper piece 13 and the sealing tape 18 so that when the opening piece 15 is picked and pulled, a cut-off portion of the upper piece 13 can be readily cut, thereby being capable of easily opening the paper container 10.

Figure 9:
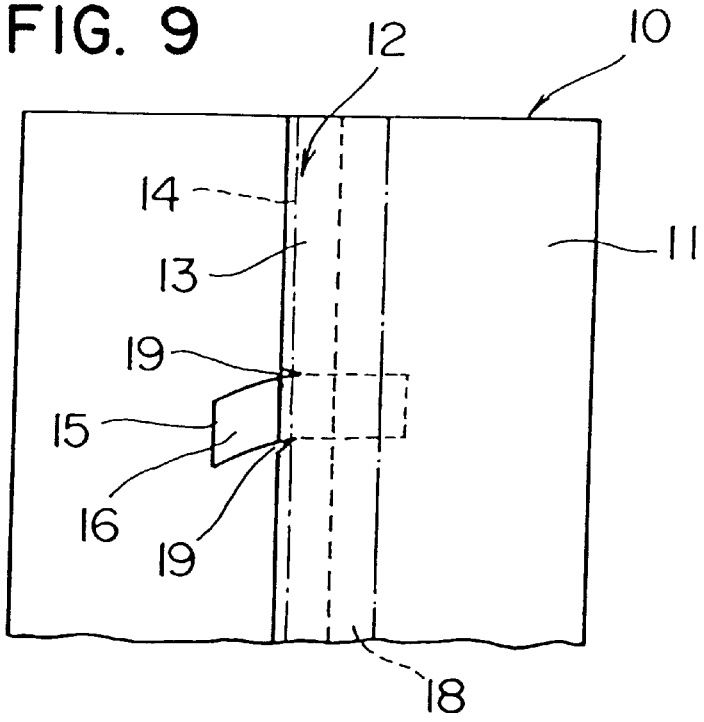
FIG. 9 is a side view showing a main portion of an easily laterally opened type paper container in accordance with still another embodiment of the present invention.
Figure 10:
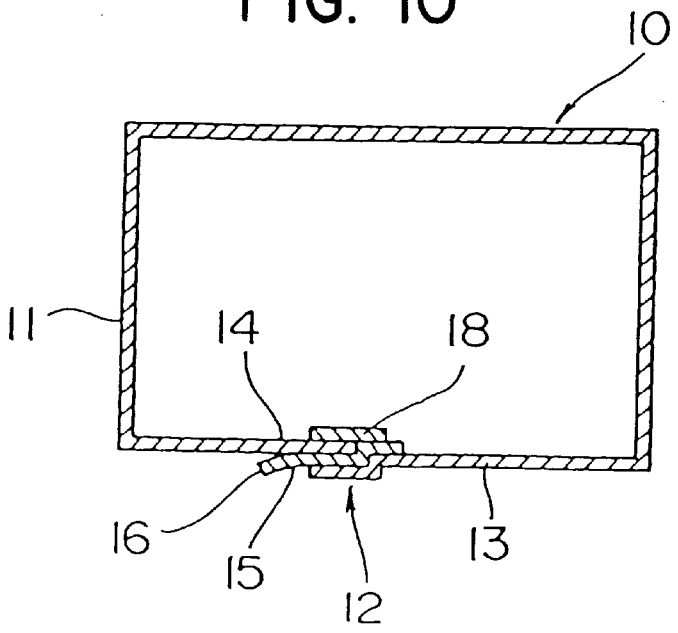
FIG. 10 is a lateral cross-sectional view showing a main portion of the easily laterally opened type paper container shown in FIG. 9.

Further, in the example shown in FIGS. 9 and 10, the sealing property is slightly lower than that in the example shown in FIGS. 6 to 8. However, the opening of the paper container is further facilitated. In this example, the one end of the opening piece 15 is sandwiched and heat-sealed between the upper piece 13 and the sealing tape 18 so that it is projected outwardly from the end portion of the sealing tape 18.

With this structure, the sealing strength between the upper piece 13 and the sealing tape 18 is further weakened by the opening piece 15 interposed between the upper piece 13 and the sealing tape 18. Thus, when the opening piece 15 is picked and pulled, a cut-off portion of the upper piece 13 can be readily cut by the weaker force.

Figure 11:
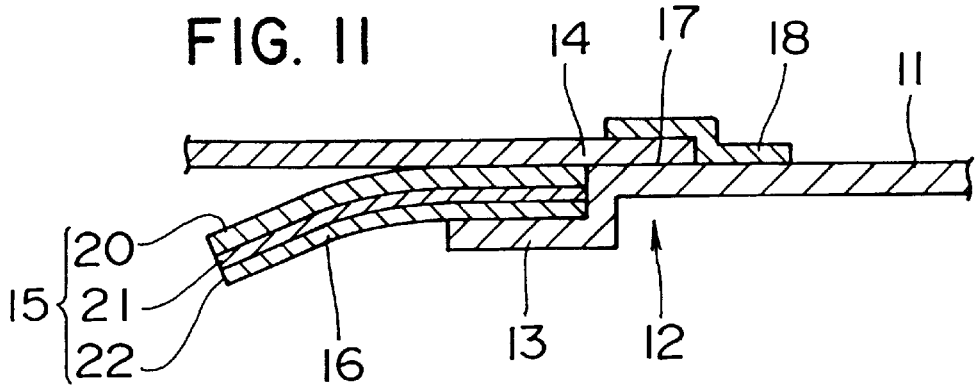
FIG. 11 is a lateral cross-sectional view showing a main portion of an easily laterally opened type paper container in accordance with yet another embodiment of the present invention.

FIG. 11 shows an easily laterally opened type paper container in accordance with still another embodiment of the present invention. The opening piece 15 is formed of multi-layer laminates. A layer on the front surface of the opening piece 15 is heat-sealed onto the container material 11 with a sealing strength larger than that between a layer on the rear surface thereof and the container material 11. This example is of a double-layer structure in which a polyethylene layer 22 is laminated on the front surface of the polyester layer 20, which is one kind of an air-barrier resin, through an anchor coat 21, which is an adhesive.

The opening piece 15 of this structure is held between the upper piece 13 and the lower piece 14, which are made up of both side ends of the container material 11 overlapped on one another when vertically sealing the paper container. When the opening piece 15 is heat-sealed to the upper and lower pieces 13 and 14, the polyethylene layer 22 that constitutes the front surface of the opening piece 15 is firmly heat-sealed onto the low-density polyethylene film which is laminated on the rear surface of the upper piece 13. However, the polyester layer 20 that constitutes the rear surface of the opening piece 15 has a low affinity with the low-density polyethylene film which is laminated on the front surface of the lower piece 14, thereby not obtaining a strong adhesion.

With this structure, when opening starts by pulling the opening piece 15, the polyester layer 20 on the rear surface of the opening piece 15 readily peels off from the container material 11, and the polyethylene layer 22 on the front surface does not peel off therefrom because it is strongly heat-sealed onto the container material 11. Thereby the lateral opening of the paper container 10 by pulling the opening piece 15 is easily and accurately conducted.

Figure 12:
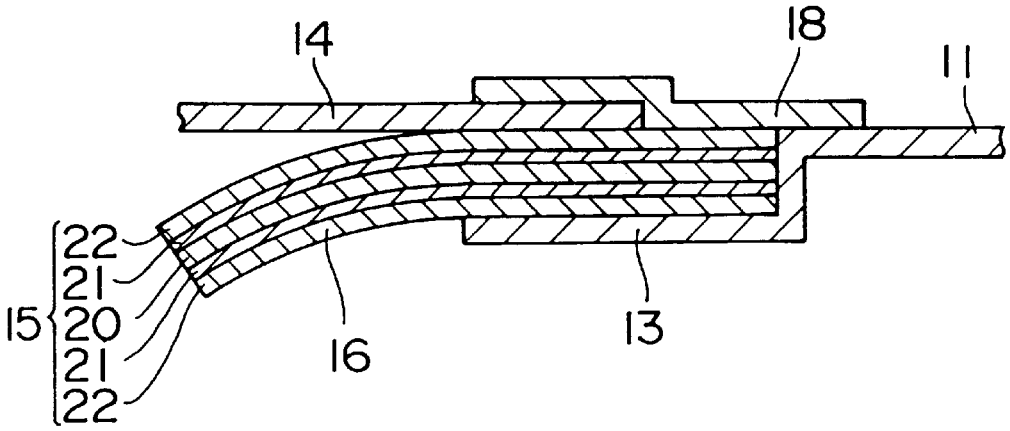
FIG. 12 is a lateral cross-sectional view showing a main portion of an easily laterally opened type paper container in accordance with yet another embodiment of the present invention.

FIG. 12 shows an easily laterally opened type paper container in accordance with still another embodiment of the present invention. This embodiment relates to the opening piece 15 having a three-layer structure in which a polyethylene layer 22, a polyester layer 20 and a polyethylene layer 22 are laminated on the front surface in the stated order. Anchor coat 21 is interposed between the polyethylene layer 22 and the polyester layer 20.

With this structure, since the front surface of the opening piece 15 is made of the same material as the rear surface, no curl occurs. This makes it easy to handle the opening piece 15 during a paper container assembling process.

Figure 13:
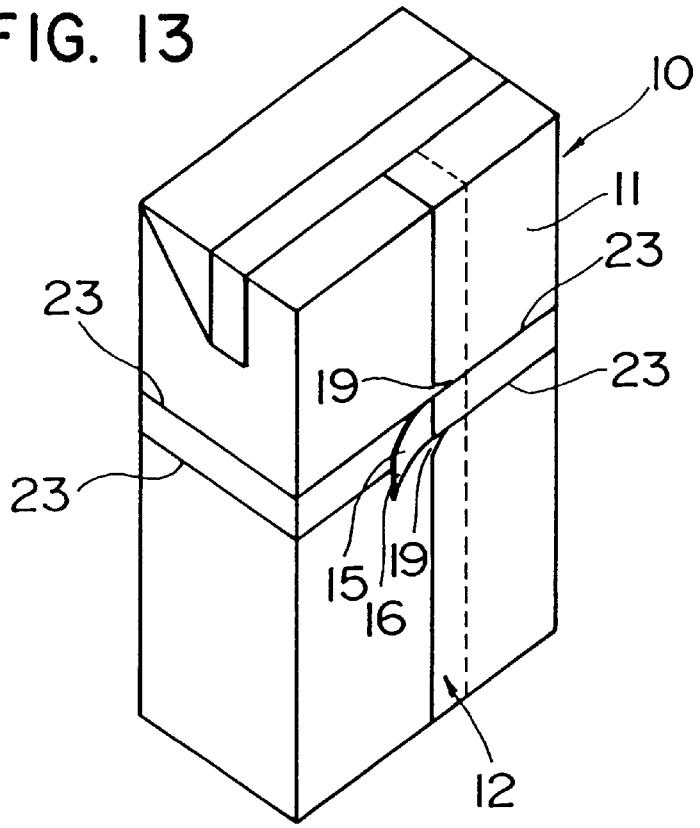
FIG. 13 is a perspective view showing an easily laterally opened type paper container in accordance with yet another embodiment of the present invention.

FIG. 13 shows an easily laterally opened type paper container in accordance with yet another embodiment of the present invention. Two parallel half-cut lines 23 are laterally formed around a container body on an outer surface of the container material 11 of the paper container 10 of the embodiments shown in FIGS. 1, 6 and 9 in such a manner that each depth reaches a paper material around a container body laterally. The two parallel half-cut lines 23 are preferably provided on a lateral extension line from the two notches 19 defined in the upper piece 13 of the overlap portion 12. Those two half-cut lines 23 may be in the form of perforations or the like, although not being shown.

With the above structure, when the opening piece 15 is pulled laterally, those two half-cut lines 23 of the paper container 10 are cut, and a portion defined between those two half-cut portions 23 is cut off in the belt-like shape without any troubles, thereby more surely being capable of conducting the opening of the paper container 10.

Figure 14:
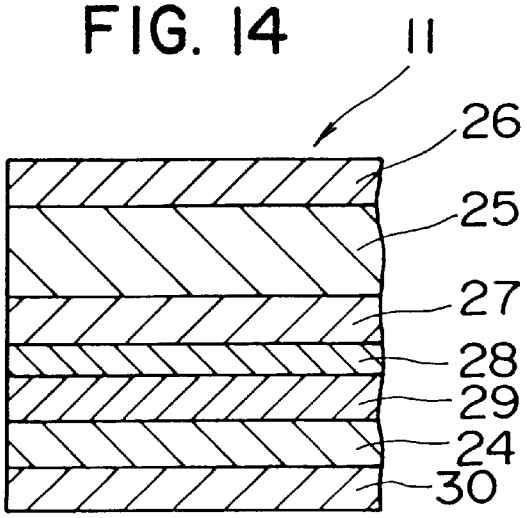
FIG. 14 is a cross-sectional view showing a main portion of an example of a laminate structure of a container material used for the easily laterally opened type paper container in accordance with the present invention.

FIG. 14 shows one example of the laminate structure of the container material 11 used for the paper container 10 of the present invention, in which a low-density polyethylene film 26 is laminated on the front surface of the paper material 25. Also, an aluminum foil 28 is laminated on the rear surface (liquid contact surface) of the paper material 25 through an adhesive 27. An oriented polyolefin film 24 having a characteristic such that the stretching ratio in one direction is larger than that in a direction orthogonal to the one direction is laminated on the aluminum foil 28 through an adhesive 29, and a lower-density polyethylene film 30 is laminated on the oriented polyolefin film 24. The oriented polyolefin film 24 is laminated such that the larger oriented direction of the film coincides with the opening direction of the paper container 10.

Figure 15:
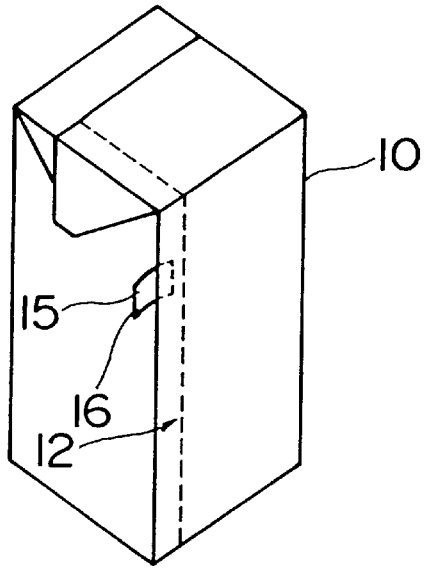
FIG. 15 is a perspective view showing an easily laterally opened type paper container in accordance with yet another embodiment of the present invention.
Figure 16:
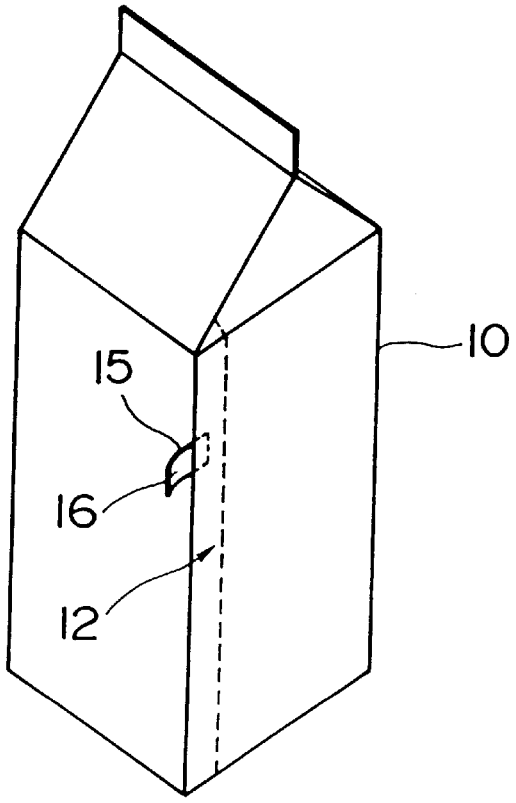
FIG. 16 is a perspective view showing an easily laterally opened type paper container in accordance with yet another embodiment of the present invention.
Figure 17:
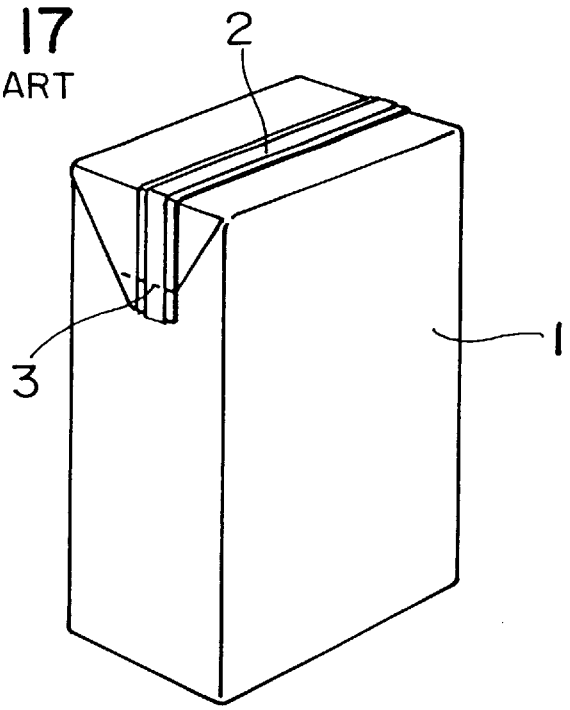
FIG. 17 PRIOR ART
FIG. 17 is a perspective view showing a conventional paper container.
Figure 18:
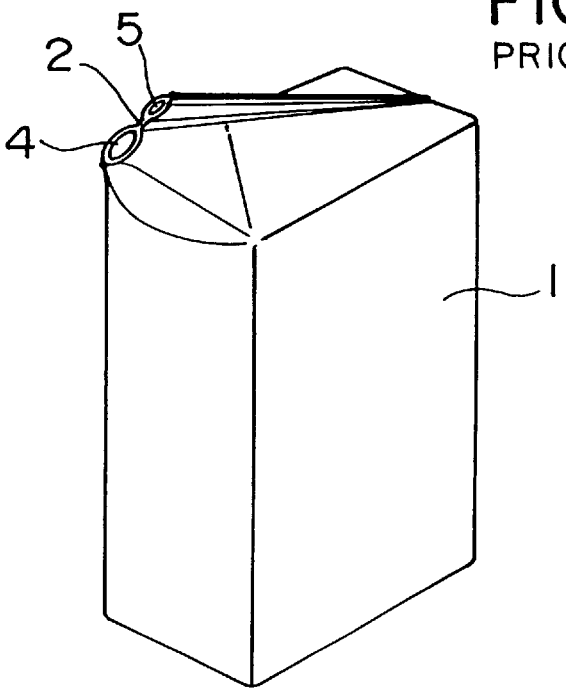
FIG. 18 PRIOR ART
FIG. 18 is a perspective view showing a state in which the paper container shown in FIG. 17 is opened.
Figure 19:
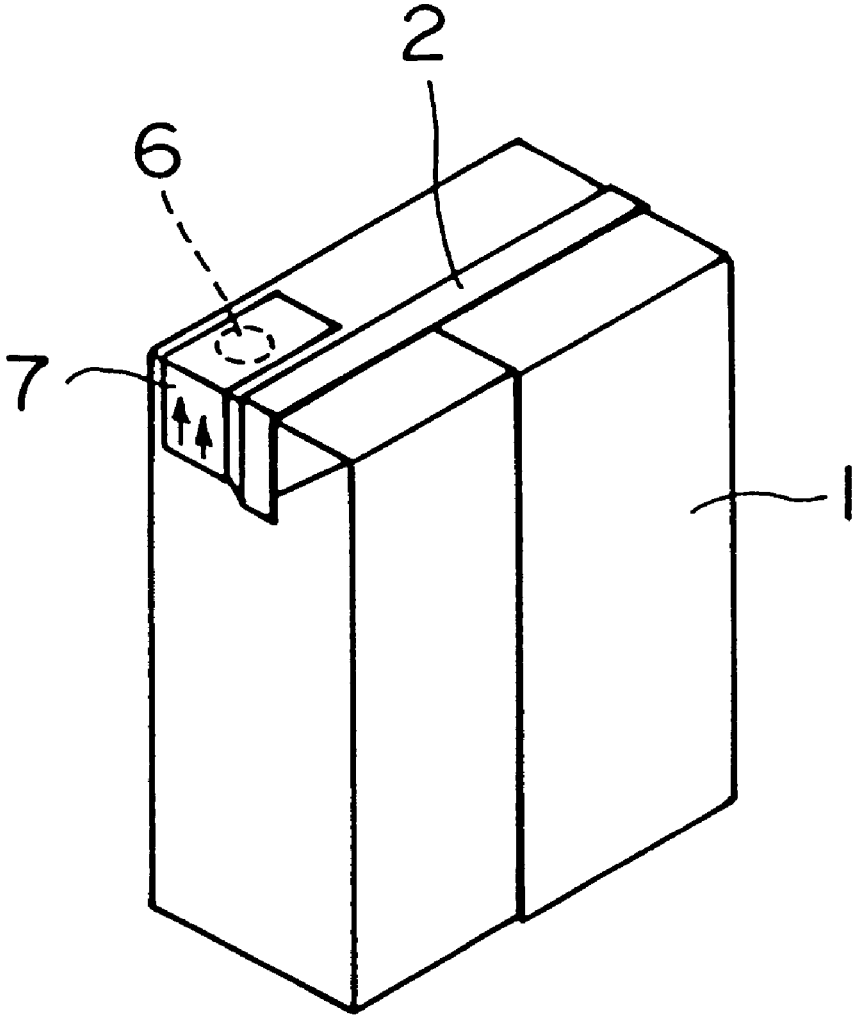
FIG. 19 PRIOR ART
FIG. 19 is a perspective view showing another conventional paper container.

The easily laterally opened type paper container of the present invention is applicable to a brick type paper container (FIG. 1) in which, after a roll-feed container material is vertically sealed in a flow direction so as to be cylindrical, the container is formed and filled with the contents while the lateral sealing and the cutting are appropriately repeated. A flat top type container (FIG. 15) and a Gable type paper container (FIG. 16) or the like are obtained in such a manner that container blanks into which the container material have been cut off in a predetermined shape in advance are assembled. After vertically sealing, the lateral sealing of the bottom portion, filling of the paper container with the contents and the lateral sealing of the top portion are performed.

According to the easily laterally opened type paper container of the present invention, the opening piece which is sandwiched and heat-sealed between the overlap portions of the paper container readily laterally cut off the paper container, starting from the notches. Consequently, the paper container is separated into upper and lower portions, thereby being capable of readily opening the paper container.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention.

The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

We claim:

1. A container, comprising:

a container material having thermoplastic resin layers on both an outer surface and an inner surface thereof, said container material being overlapped and heat-sealed between one side and another side thereof and including an overlap portion which includes an upper piece and a lower piece;

an opening piece which has a picking length and sides, which is formed of a resin film and which is sandwiched and heat-sealed between said upper piece and said lower piece of said overlap portion of said container material;

two notches defined in said upper piece of said overlap portion in correspondence with said sides of said opening piece; and an oriented polyolefin film having a stretching ratio in one direction larger than that in a direction orthogonal to the one direction and being laminated to form an inner layer of said container material such that the one direction having the larger stretching ratio coincides with an opening direction of the container.

2. A container as claimed in claim 1, and further comprising a sealing tape heat-sealed onto a rear side of said overlap portion of said container material so as to heat-seal rear sides of both said upper piece and said lower piece.

3. A container as claimed in claim 2, wherein said opening piece is sandwiched and heat-sealed between said upper piece and said lower piece so that one end of said opening piece projects outwardly of an end portion of said lower piece.

4. A container as claimed in claim 1, wherein said opening piece has a front surface and a rear surface and is heat-sealed onto said container material so that said front surface has a larger adhesive strength than said rear surface.

5. A container as claimed in claim 2, wherein said opening piece has a front surface and a rear surface and is heat-sealed onto said container material so that said front surface has a larger adhesive strength than said rear surface.

6. A container as claimed in claim 3, wherein said opening piece has a front surface and a rear surface and is heat-sealed onto said container material so that said front surface has a larger adhesive strength than said rear surface.

7. A container as claimed in claim 1, wherein said opening piece comprises a laminate of at least two layers.

8. A container as claimed in claim 2, wherein said opening piece comprises a laminate of at least two layers.

9. A container as claimed in claim 3, wherein said opening piece comprises a laminate of at least two layers.

10. A container as claimed in claim 4, wherein said opening piece comprises a laminate of at least two layers.

11. A container as claimed in claim 1, wherein said container material forms a container body, wherein said container material comprises a paper material between said thermoplastic resin layers, and further comprising two parallel half-cut lines extending from a respective one of said two notches of said upper piece of said overlap portion laterally around the container body on said outer surface of said container material, said two parallel half-cut lines having a depth which extends to said paper material.

12. A container as claimed in claim 2, wherein said container material forms a container body, wherein said container material comprises a paper material between said thermoplastic resin layers, and further comprising two parallel half-cut lines extending from a respective one of said two notches of said upper piece of said overlap portion laterally around the container body on said outer surface of said container material, said two parallel half-cut lines having a depth which extends to said paper material.

13. A container as claimed in claim 3, wherein said container material forms a container body, wherein said container material comprises a paper material between said thermoplastic resin layers, and further comprising two parallel half-cut lines extending from a respective one of said two notches of said upper piece of said overlap portion laterally around the container body on said outer surface of said container material, said two parallel half-cut lines having a depth which extends to said paper material.

14. A container as claimed in claim 4, wherein said container material forms a container body, wherein said container material comprises a paper material between said thermoplastic resin layers, and further comprising two parallel half-cut lines extending from a respective one of said two notches of said upper piece of said overlap portion laterally around the container body on said outer surface of said container material, said two parallel half-cut lines having a depth which extends to said paper material.

15. A container as claimed in claim 7, wherein said container material forms a container body, wherein said container material comprises a paper material between said thermoplastic resin layers, and further comprising two parallel half-cut lines extending from a respective one of said two notches of said upper piece of said overlap portion laterally around the container body on said outer surface of said container material, said two parallel half-cut lines having a depth which extends to said paper material.

16. A container as claimed in claim 1, wherein said container material comprises paper so as to form an aseptic container body.

17. A container as claimed in claim 2, wherein said container material comprises paper so as to form an aseptic container body.

18. A container as claimed in claim 3, wherein said container material comprises paper so as to form an aseptic container body.

19. A container as claimed in claim 4, wherein said container material comprises paper so as to form an aseptic container body.

20. A container as claimed in claim 7, wherein said container material comprises paper so as to form an aseptic container body.

* * * * *